US005277393A

United States Patent [19]

Nicholson et al.

[11] Patent Number: 5,277,393

[45] Date of Patent: Jan. 11, 1994

[54] SHELVING UNIT

[75] Inventors: Roy C. Nicholson, Hickory, N.C.; Michael E. Barrett, Gainesville; Steven R. Burns, Duluth, both of Ga.; Robert W. Lackey, Hickory, N.C.

[73] Assignee: McCalla/Lackey Corporation, Hickory, N.C.

[21] Appl. No.: 917,745

[22] Filed: Jul. 23, 1992

Related U.S. Application Data

[63] Continuation of Ser. No. 737,800, Jul. 29, 1991, abandoned, which is a continuation of Ser. No. 513,919, Apr. 24, 1990, abandoned, which is a continuation-in-part of Ser. No. 321,378, Mar. 10, 1989, Pat. No. 4,928,913, and a continuation-in-part of Ser. No. 364,962, Jun. 12, 1989, abandoned.

[51] Int. Cl.[5] ..... E04G 3/08

[52] U.S. Cl. ..... 248/243; 108/108; 211/187; 248/223.4; 248/235

[58] Field of Search ..... 248/243, 247, 248, 125, 248/224.4, 223.4, 224.1, 224.2; 211/187, 208; 108/42, 50, 108; 52/36

[56] References Cited

U.S. PATENT DOCUMENTS

| | | | |
|---|---|---|---|
| 2,191,701 | 2/1940 | Wood . | |
| 3,136,520 | 6/1964 | Reiss . | |
| 3,234,897 | 2/1966 | Berk . | |
| 3,502,293 | 3/1970 | Bard . | |
| 3,604,669 | 8/1971 | Asher . | |
| 3,765,344 | 10/1973 | Ferdinand . | |
| 4,013,253 | 3/1977 | Perrault et al. | 248/243 X |
| 4,467,729 | 8/1984 | Featherman | 248/243 X |
| 4,531,698 | 7/1985 | Sharber . | |
| 4,928,913 | 5/1990 | Laughon | 248/243 |

FOREIGN PATENT DOCUMENTS

| | | | |
|---|---|---|---|
| 1288266 | 1/1969 | Fed. Rep. of Germany | 211/187 |
| 1198887 | 7/1970 | United Kingdom . | |

*Primary Examiner*—David A. Scherbel
*Assistant Examiner*—Derek J. Berger
*Attorney, Agent, or Firm*—Hardaway Law Firm

[57] ABSTRACT

A shelf-supporting assembly is provided with a vertical standard having a front and back portion, a shelf bracket extending outwardly from the vertical standard, a flange at a base portion of the shelf bracket extending inwardly in parallel with the front portion of the vertical standard, hook-shaped projection extending from the flange, spaced members defining gaps therebetween connecting the front portion of the vertical standard to the back portion, with the hook-shaped projections projecting through the gap defined between the spaced members, removably and supportably attaching the shelf bracket to the vertical standard.

9 Claims, 2 Drawing Sheets

SHELVING UNIT

CROSS REFERENCE TO RELATED APPLICATIONS

This application is a continuation of application Ser. No. 07/737,800, filed Jul. 29, 1991, now abandoned, which is a continuation of application Ser. No. 07/513,919, filed Apr. 24, 1990, now abandoned, which is a continuation-in-part of application Ser. No. 07/321,378, filed Mar. 10, 1989, now U.S. Pat. No. 4,928,913, and application Ser. No. 07/364,962, filed Jun. 12, 1989, now abandoned.

BACKGROUND OF THE INVENTION

The present invention relates generally to adjustable supports for shelving, and more particularly to shelf supporting assemblies using vertical standards with shelf supporting brackets thereon.

Support assemblies for shelving and the like, using vertical standards and shelf supporting elements which may be readily assembled to each other and adjusted for variations in height without tools and auxiliary locking screws or levers, are common in the art. Examples of such assemblies are found in U.S. Pat. 3,136,520 to Reiss, U.S. Pat. No. 3,234,897 to Berk, U.S. Pat. No. 3,502,293 to Bard, U.S. Pat. No. 3,604,669 to Asher, and U.S. Pat. No. 4,531,698 to Sharber. However, the vertical standards of the prior art while functional are unattractive with exposed screw holes and engagement slots for receiving a bracket.

SUMMARY OF THE INVENTION

It is thus an object of the invention to provide a shelf supporting assembly having a novel structure.

It is a further object of the invention to provide a shelf supporting assembly with means for decoratively covering exposed screw holes and engagement slots.

These as well as other objects are accomplished by providing a shelf supporting assembly having a vertical standard with a front and back portion, a shelf bracket extending perpendicularly outwardly from the vertical standard; a flange at a base portion of the shelf bracket extending inwardly in parallel with the front portion of the vertical standard, hook shaped projections extending from the flange, spaced members defining gaps therebetween while connecting the front portion of the vertical standard to the back portion of the vertical standard, with the hook shape projection projecting through the gaps defined between the spaced members, thereby removably and supportably attaching the shelf bracket to the vertical standard.

DETAILED DESCRIPTION

Figures 1, 2:
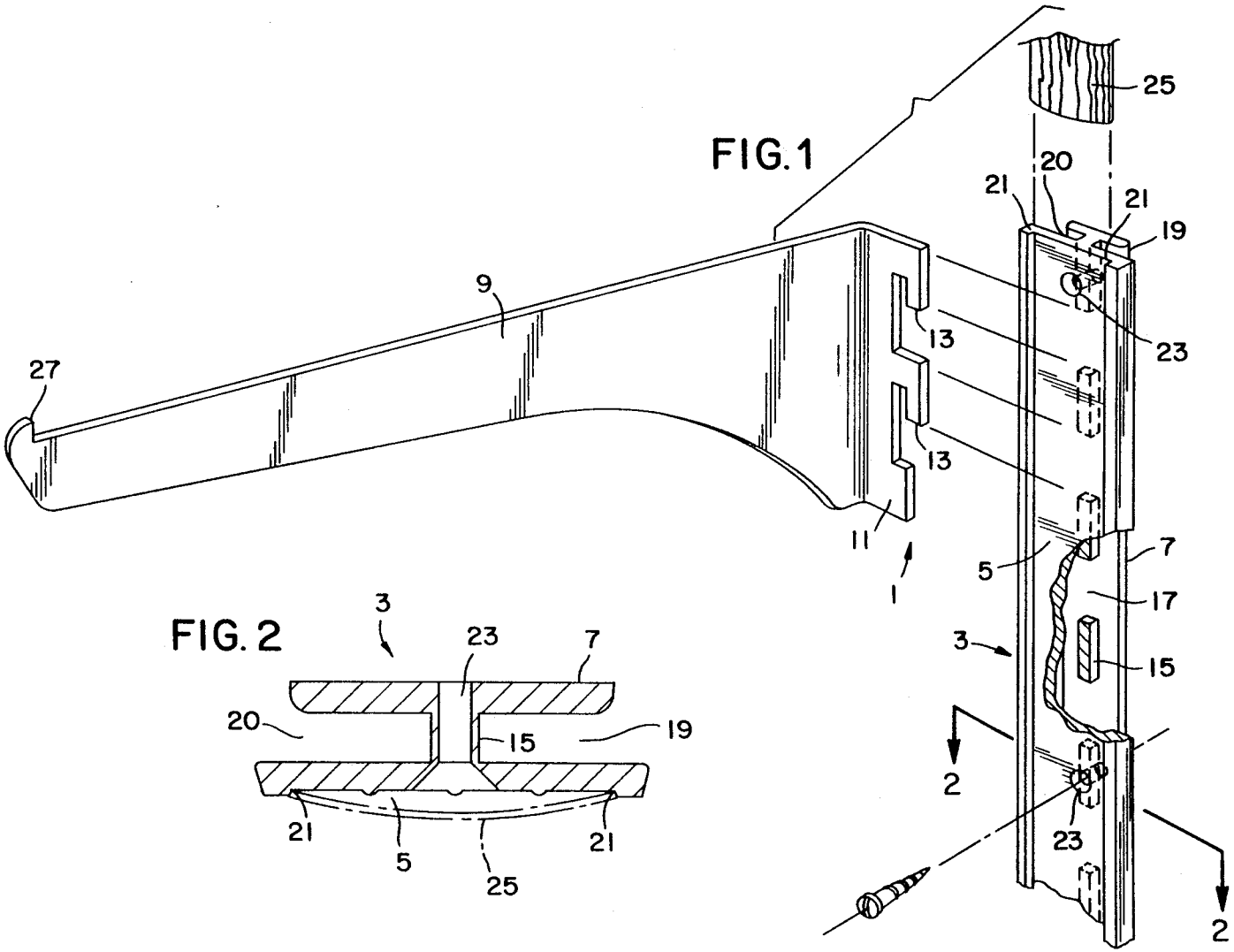
FIG. 1 is an exploded perspective view of the apparatus of the present invention.
FIG. 2 is a traverse cross-section along the line 2—2 of FIG. 1 of the vertical standard of the present invention.

The prior art of shelf supporting assemblies commonly teaches vertical standards having engagement slots along the front side thereof for engaging hooked projections extending directly from shelf brackets. In accordance with the present invention, however, vertical standards are provided with engagement slots along the sides thereof to allow a decorative insert to be received in a longitudinal slot along the front portion of the vertical standard for covering screw holes. Additionally, a decorative insert may be received in slots defined along the sides carrying the engagement slots. Various other advantages and features will become apparent from the following description given with reference to the various figures in the drawings.

FIG. 1 illustrates a shelf supporting assembly 1 in accordance with the present invention. Vertical standard 3 has a front portion 5 and back portion 7. Shelf bracket 9 extends perpendicularly outwardly from the vertical standard 7. Flange 11 at a base portion of the shelf bracket extends inwardly in parallel with front portion 5 of the vertical standard. Flange 11 has hook-shaped projections 13 extending therefrom for engagement with the vertical standard.

As best seen in FIG. 2, a preferred embodiment of the vertical standard 3 comprises a generally H-shaped structure. A front portion 5 and a back portion 7 of standard 3 are attached by a vertically aligned series of spaced members 15 defining gap 17 therebetween. Spaced members join the approximate midpoint of back portion 7 to the approximate mid point of front portion 5.

Figure 3:
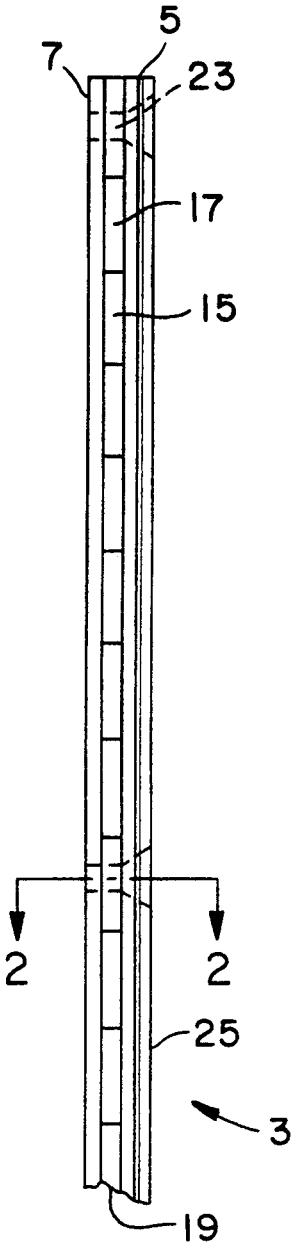
FIG. 3 is the side view of the vertical standard of the present invention.

As is seen in FIG. 3, the gaps 17 form engagement slots for receiving the hook-shaped projections 13 of the shelf bracket. Thus, flange 11 is inserted into slot 19 defined between front portion 5 and rear portion 7 and hook-shaped projections 13 are slid into respective gaps 17 for removably, supportably attaching the shelf bracket to the vertical standard.

It has been surprisingly found that by utilizing a vertical standard 3 having both a front portion 5 and back portion 7 that flange 11 and its projection 13 are supported both in the front and in the rear to horizontally stabilize the bracket 9 and any shelves supported thereby.

It is seen that this assembly allows a longitudinal slot 21 to be defined along front portion 5. Screw holes 23 extend between front portion 5, spaced members 15 and rear portion 7 for securing the vertical standard to a wall as by a screw. Decorative insert 25 is received by longitudinal slot 21 for decoratively covering screw holes 23. Additionally, decorative inserts may be provided for covering slot 19 opposite shelf bracket 9.

Thus a shelving unit in accordance with the present invention is assembled by securing a plurality of spaced vertical standards to a wall by driving screws through screw holes 23. Shelf brackets are attached to the vertical standards by, inserting their flanges into the slots 19 thereby engaging hooked projections 13 in the gaps 17. Decorative inserts 25 are then slid into longitudinal slot 21. Additional decorative inserts (not shown) may be inserted into exposed slot 20 for covering gaps 17.

It should be noted that, although the shelf brackets for use with the present invention may be provided in left handed and right handed configurations, a shelf bracket inserted into either side of a vertical standard will support a shelf. Only an aesthetically desirable appearance of symmetry requires that the two shelf brackets at opposed ends of a shelf assembly either face each other, as by having their flanges point inwardly toward each other, or face away from each other, as by having their flanges point in opposite directions. It is essential to this invention, however, that only a single direction be utilized by each bracket. For completion of the shelving assembly a shelf is placed on the shelf brackets and held in place by supporter 27.

Figure 4:
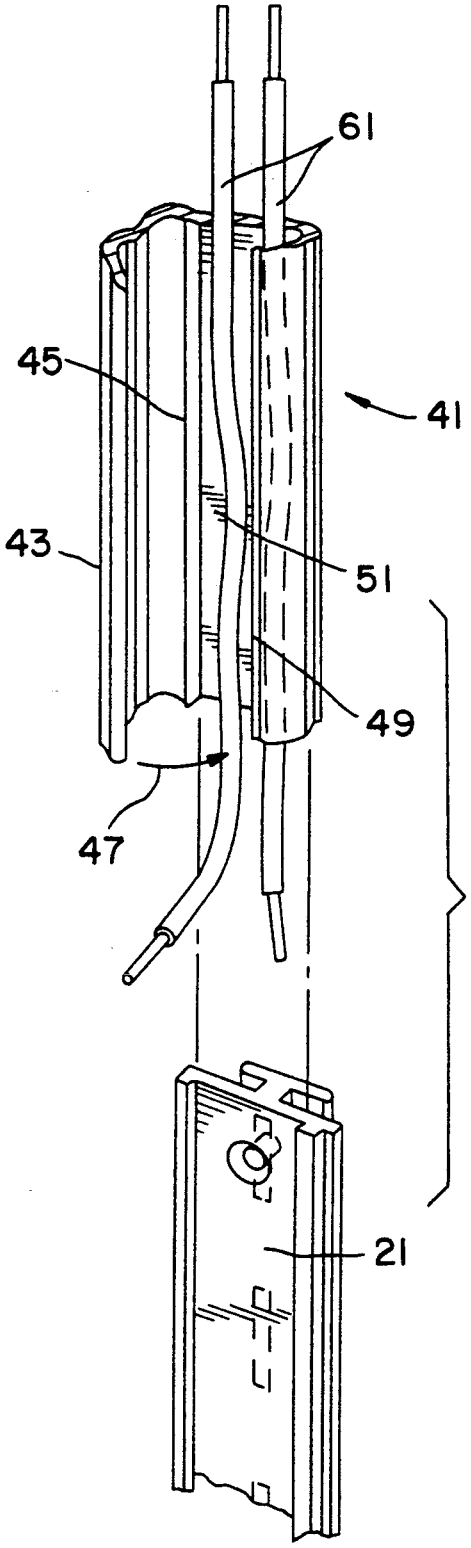
FIG. 4 is a perspective view of a different embodiment of this invention.

FIG. 4 of the drawings illustrates a particularly desirable embodiment wherein an insert into slot 21 takes the form of accessible channeling 41. Such channeling not only mates with slot 21 but has a door 43 thereon which is movable by preferably living hinge 45 to open and close as set forth by the arrow 47. Door 43 is engageable by catch 49 to close the channel 41. When door 43 is in the closed position a passage way 51 is defined through which items for which concealment is desired may pass. Wiring 61 is illustrated herein and indeed such wiring may communicate with electrical outlets associated with the shelving units. Such a configuration results in a built look rather than an add on look.

Thus the apparatus of the present invention is a novel shelf supporting assembly having a more decorative effect than any taught by the prior art. As various other advantages and features will be apparent to those of skill in the art from a reading of the foregoing description which is exemplary in nature, such variations are included within the spirit and scope of the invention as defined by the following appended claims.

That which is claimed:

1. A shelf-supporting assembly comprising:

a vertical standard having a front portion and a back portion, said front portion and said back portion joined by a series of vertically spaced members defining gaps therebetween, said vertically spaced members connected an approximate vertical midpoint of said back portion to an approximate vertical midpoint of said front portion of said vertical standard;

a shelf bracket extending perpendicularly outwardly from the vertical standard;

a flange at a base portion of said shelf bracket extending inwardly in parallel with said front portion of said vertical standard;

hook-shaped projections extending from said flange;

spaced members connecting said front portion of said vertical standard to said back portion of said vertical standard, said spaced members positioned so as to create a single file of equidistant gaps between said spaced members;

said hook-shaped projections projecting through said gaps defining between said spaced members, thereby matingly fitting said hook-shaped projections between said front portion of said vertical standard and said back portion of said vertical standard while also matingly fitting said hook-shaped projections between said spaced members; and thereby removably and supportably attaching said shelf bracket to said vertical standard.

2. The shelf-supporting assembly set forth in claim 1 further including spaced screws holes in said front portion of said vertical base extending through spaced members and said back portion receiving screws for fastening said vertical standard to wall.

3. The shelf-supporting assembly set forth in claim 1 wherein said spaced members are of a uniform width less than a width of said front and rear portions thereby forming U-shaped channels in both sides of said vertical standard for receiving the flange of said shelf bracket with said hook-shaped projections projecting through said gaps.

4. The shelf-supporting assembly set forth in claim 1 further including:

a second vertical standard spaced from said vertical standard;

a second shelf bracket parallel to said shelf bracket extending perpendicularly outwardly from said second vertical standard;

a second flange at a base portion of said second shelf bracket extending inwardly toward said vertical standard and said shelf brackets;

hook-shaped projections extending from said second flange for removably, supportably attaching said second shelf bracket to said second vertical standard.

5. A shelving assembly comprising:

at least two vertical standards;

each of said standards having a front portion and a back portion, said front portion and said back portion joined by a series of vertically spaced members defining gaps therebetween, said vertically spaced members connecting an approximate vertical midpoint of said back portion to an approximate vertical midpoint of said front portion of said vertical standard;

shelf brackets extending perpendicularly outwardly from said vertical standards;

a flange at a base portion of each of said shelf brackets extending inwardly in parallel with the front portion of one of said vertical standards;

hook-shaped projections extending from said flange;

spaced members defining gaps therebetween connecting the front portion to the back portion on each of said vertical standards, said spaced members positioned so as to create a single file of equidistant gaps between said spaced members;

said hook-shaped projections projecting through said gaps between said spaced members, thereby matingly fitting said hook-shaped projections between said front portion of said vertical standard and said back portion of said vertical standard while also matingly fitting said hook-shaped projections between said spaced members;

thereby removably and supportably attaching said shelf bracket to said vertical standard; and a shelf positioned on and across said shelf brackets.

6. A shelf supporting assembly comprising:

a vertical standard having a front portion and a back portion;

a shelf bracket extending outward from the vertical standard;

space members connecting said front portion of said vertical standard to said back portion of said vertical standard, said space members positioned so as to created equidistant gaps between said spaced members;

a shelf mounting bracket supported in said gap;

said front portion defining a longitudinal slot in the front portion thereof;

a channel insert positioned within said slot said channel having a door hinged thereon for opening and closing.

7. A shelf-supporting assembly comprising:

a vertical standard having a front portion and a back portion;

a shelf bracket extending perpendicularly outward from the vertical standard;

a flange at a base portion of said shelf bracket extending inwardly in parallel with said front portion of said vertical standard;

hooked-shaped projections extending from said flange;

spaced members connecting said front portion of said vertical standard to said back portion of said vertical standard, said spaced members positioned so as to create equidistant gaps between said spaced members;

said hook-shaped projections projecting through said gaps between said spaced members, thereby matingly fitting said hook-shaped projections between said front portion of said vertical standard and said back portion of said vertical standard while also matingly fitting said hook-shaped projections between said spaced members;

spaced screw holes in said front portion of said vertical standard extending through spaced members and said back portion receiving screws for fastening said vertical standard to wall;

a longitudinal slot defined in said front portion;

a decorative insert received in said slot covering said spaced screw holes, said decorative insert comprises a channel said channel having a door hinged thereon for opening and closing about a catch said channel defining a channel passageway for passage of concealed items therethrough;

thereby removably and supportably attaching said shelf bracket to said vertical standard.

8. The apparatus according to claim 7 wherein said shelf bracket comprises a single arm.

9. A shelf-supporting assembly comprising:

a vertical standard having a front portion and a back portion;

a shelf bracket extending perpendicularly outward from the vertical standard;

a flange at a base portion of said shelf bracket extending inwardly in parallel with said front portion of said vertical standard;

hooked-shaped projections extending from said flange;

spaced members connecting said front portion of said vertical standard to said back portion of said vertical standard, said spaced members positioned so as to create equidistant gaps between said spaced members;

said hook-shaped projections projecting through said gaps between said spaced members, thereby matingly fitting said hook-shaped projections between said front portion of said vertical standard and said back portion of said vertical standard while also matingly fitting said hook-shaped projections between said spaced members;

spaced screw holes in said front portion of said vertical standard extending through spaced members and said back portion receiving screws for fastening said vertical standard to wall;

a longitudinal slot defined in said front portion;

a decorative insert received in said slot covering said spaced screw holes, said decorative insert comprises a channel said channel having a door hinged thereon for opening and closing about a catch said channel defining a channel passageway for passage of concealed items therethrough; and thereby removably and supportably attaching said shelf bracket to said vertical standard.

* * * * *